United States Patent [19]

Ayers

[11] 4,380,406

[45] Apr. 19, 1983

[54] JACKUP PLATFORM TRAILER

[75] Inventor: Ray R. Ayers, Houston, Tex.

[73] Assignee: Shell Oil Company, Houston, Tex.

[21] Appl. No.: 258,855

[22] Filed: Apr. 29, 1981

[51] Int. Cl.[3] ..... B63B 35/02

[52] U.S. Cl. ..... 405/206; 114/264; 405/195; 405/203

[58] Field of Search ..... 405/195–209, 405/222–228; 175/5–10; 141/387, 388; 114/259, 264, 265

[56] References Cited

U.S. PATENT DOCUMENTS

| | | | |
|---|---|---|---|
| 2,602,636 | 7/1952 | Travers . | |
| 2,921,442 | 1/1960 | Laborde et al. | 405/207 |
| 2,938,352 | 5/1960 | Knapp et al. | 405/207 |
| 3,022,633 | 2/1962 | Stimson | 405/207 X |
| 3,323,478 | 6/1967 | Hunsaker . | |
| 3,378,086 | 4/1968 | Kivisild | 175/7 |
| 3,385,069 | 5/1968 | Estes | 405/207 X |
| 3,435,571 | 4/1969 | Oltermann et al. | 52/119 |
| 3,572,408 | 3/1971 | Hnot | 141/387 |
| 3,765,463 | 10/1973 | Gassett et al. | 141/388 |
| 4,156,577 | 5/1979 | McMakin | 405/209 |
| 4,217,848 | 8/1980 | Meyer-Haake | 114/264 |

OTHER PUBLICATIONS

Engineering News-Record, Jul. 21, 1960, "Floating Crane Sinks Itself", p. 52.

"The Technology of Offshore Drilling, Completion and Production" by ETA Seminars, Inc., 1976, p. 4.

"Manned Submersibles" by R. Frank Busby, 1976, p. 611, Office of the Oceanographer of the U.S. Navy.

*Primary Examiner*—Dennis L. Taylor

[57] ABSTRACT

A jackup platform trailer for surface or undersea work is formed from a deck structure supported by a submersible flotation means. In a transport mode, the deck structure is linked via a gooseneck arm and swivel joint to a workboat. In an operational mode, the submersible flotation means is fully submersed to support the deck structure from the ocean floor, without need for an attached workboat.

25 Claims, 2 Drawing Figures

JACKUP PLATFORM TRAILER

BACKGROUND OF THE INVENTION

Many thousands of vessels form a fleet of marine transportation boats serving companies working in offshore waters throughout the world. The vast majority of these vessels support offshore oil and gas exploration and production activities. Most of these vessels are classed as tugboats, supply boats, or crew boats, and have displacement type hulls. A common problem with such hulls is that it is difficult for men to perform useful work from the decks thereof due to waves which wet the decks and which cause excessive roll and pitch motions of the vessels. Weather in the Gulf of Mexico is occasionally severe enough to hinder or delay operations, but weather in the North Sea is so severe as to have a significant impact on operations from such vessels. Transfer of men and equipment to offshore platforms, handling of anchor buoys, and deployment of men and equipment subsea are examples of operations wherein a safe and stable work platform is needed.

A potential solution to this problem is to build and use larger vessels. This slightly improves the situation, but at a significantly increased cost, and generally it is not considered an economically feasible approach.

Another potential solution is to build a fleet of small to medium sized, column-stabilized, semi-submersible vessels like the larger semi-submersible vessels used for drilling operations. These are stable work platforms having long natural periods of response in the order of 20 to 40 seconds. By contrast, a 200-foot supply boat has natural periods of from 6 to 9 seconds, which is quite close to the period range of highest wave energy. While such semi-submersibles would significantly reduce wave-induced motions and deck wetness, it would be at an excessive cost of retiring the conventional fleet and building a new and more expensive fleet.

REFERENCE TO RELATED APPLICATION

This application is related to application Ser. No. 197,399 filed Oct. 16, 1980.

SUMMARY OF THE INVENTION

The present invention generally pertains to a jackup platform trailer which is a floatable deck structure supported by submersible flotation means, with means for extending the submersible flotation means downwardly beneath the deck structure, means for pivoting the flotation means and deck structure, and connecting means extending between the deck structure and the pivoting means.

In a preferred embodiment, the submersible flotation means is two connected pontoons, and the pivoting means is a ball swivel joint.

The present invention also relates to a method for transporting and positioning a jackup platform trailer which is a deck structure supported by downwardly extendable, submersible flotation means and connection means extending from the deck structure to pivoting means connectable to a tow vessel, by towing the trailer with the vessel to a desired location, partially ballasting down the flotation means to stabilize the trailer, releasing the pivoting means from the vessel, and fully ballasting down the flotation means to the sea floor.

More generally, the present invention pertains to a jackup platform trailer for surface or subsea work which is a deck structure supported by submersible flotation means and attachable to a workboat for transport. Pontoon legs attached to the submersible flotation means are extendable beneath the deck structure which is connected to the workboat or other support means via a gooseneck truss, trailer tongue or the like, and a ball swivel joint or the equivalent. When not in use, or in transit, the unit may be deballasted to ride high in the water and permit entrance to shallow harbors.

PREFERRED EMBODIMENT OF THE INVENTION

The present invention provides a new solution to problems of offshore handling and transfer operations in rough weather. Generally, the invention is a deck structure supported by submersible flotation means and towable by a conventional vessel such as a supply boat, or by other means. The deck structure is pivotable from a raised transit mode to a lowered mode from which the flotation means is fully submerged until it rests on bottom. With the jackup trailer/work platform, workmen can do useful work on a stable, dry deck. Further, using the present invention, men and equipment can be easily and safely transferred from the jacked-up trailer to a subsea location or upward to an offshore platform or larger floating vessel.

Figure 1:
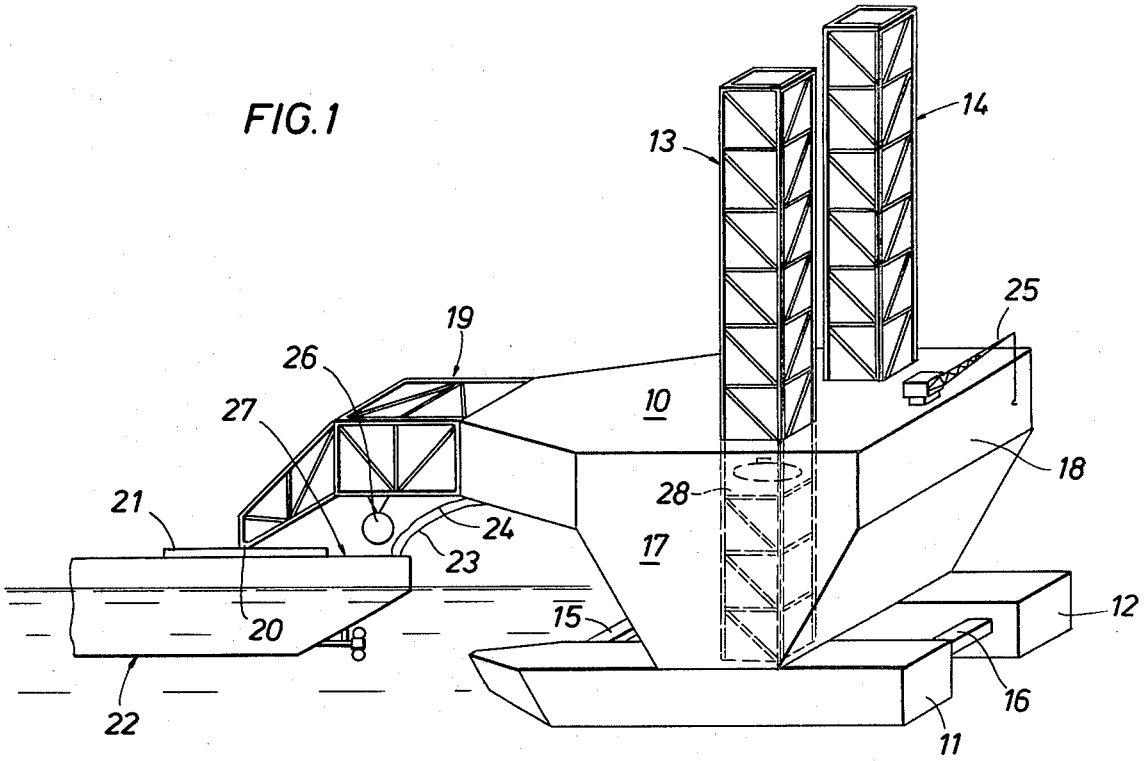
FIG. 1 discloses a view of the apparatus of the present invention in a transportation mode.
Figure 2:
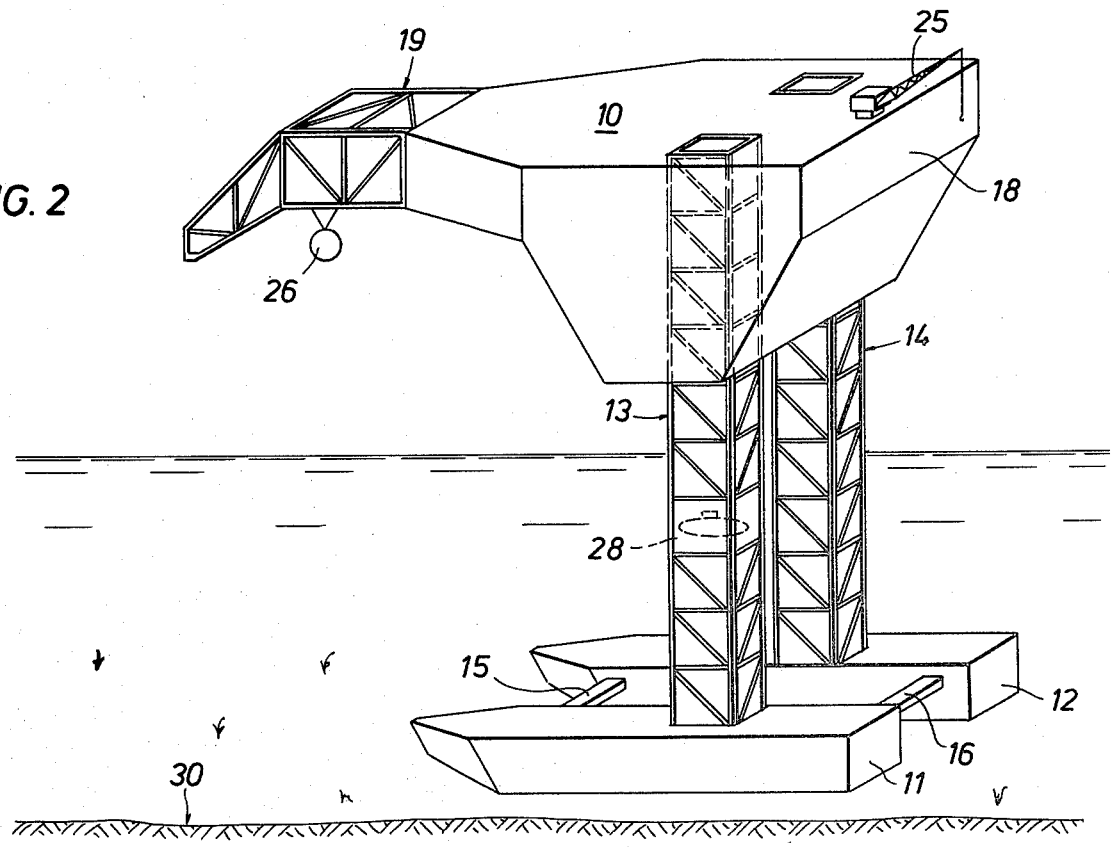
FIG. 2 provides a view of the apparatus in a working mode.

As shown in FIG. 1, beneath the deck structure are flotation means 11 and 12 (preferably pontoons) which may be in a lowered position for work use (as shown in FIG. 2) or in a partially or fully raised position (as shown in FIG. 1) for recovery and transit. Pontoons 11 and 12 are at the ends of two vertical truss-type columns or legs 13 and 14 and are connected by cross beams 15 and 16. The vertical legs abut or are adjacent to deck sides 17 and 18. Connections means 19 (e.g. a trailer tongue or gooseneck arm) extends forwardly and connects via pivoting means 20 (preferably a ball swivel joint) which in turn can be mounted on a track or slot 21 so that it can be moved forward or aft, or even released aft in an emergency from vessel 22.

For best motion response with the jackup trailer in a transit mode, pivoting means 20 is located at the center of pitch of the supply vessel or other support means 22 to which it is attached. For storm survival, pivoting means 20 can be moved aft to minimize the risk of the underside of the deck structure 10 contacting the stern of vessel 22 while the vessel is pitching in severe waves. Low tension tieback ropes, chains or cables 23 and 24 are used to ensure that the jackup trailer does not jackknife into contact with the vessel or other support means.

As shown in FIG. 2, in the working mode of the jackup trailer, legs 13 and 14 are extended beneath deck structure 10 to the sea floor 30. While two legs and two pontoons are shown, it is evident that only one leg and one pontoon, if of sufficient dimension, could be employed. On the other hand, more than two legs and two pontoons also could be employed.

The jackup trailer can take many forms, depending on the specific application. Thus, it can support workmen for undersea work or it can be used for offloading to platforms, etc. Crane 25 may be mounted on the platform and used for a variety of offshore construction maintenance and repair operations. The jackup trailer can have various other lifting means such as gantry hoist 26 for lifting loads from deck 27 to the trailer or to move equipment and/or personnel subsea. Also, the jackup trailer can support submarine operations by installing special launch/recovery equipment. Although submarines can be launched from the trailer in various ways, it is preferred to launch from a duct 28 in leg 13 or 14.

Just like other jackup rigs, the jackup trailer 10 can be towed out in a shallow draft, low-ballast condition and then be ballasted down at the work site to perform required work. By towing the jackup trailer in a lightened condition, the reduction in tow vessel speed due to the trailer is normally small, and shallow harbors can be used. In the lightened mode, the jackup trailer has a motion response somewhat like a trimaran.

The procedure for setting the trailer is as follows: (1) the flotation means (e.g. pontoons at the bottom of legs) are jacked down (but not to the sea floor) as ballast is added thereto (which stabilizes the trailer for subsequent uncoupling operations); (2) the pivoting means (hitch, joint, swivel, etc.) is uncoupled, disconnected or released, and the connection means (tongue, gooseneck arm, etc.) raises while the vessel moves away, paying out a tow line attached to the trailer near the hitch; and (3) more ballast is added to the pontoons and the legs are jacked down until the trailer is resting on bottom. The tow line can be released at this time or be used to moor the supply vessel to the jacked-up trailer.

The procedure for recovering and moving the trailer is as follows: (1) with tow line previously attached between trailer tongue and supply vessel, the legs are jacked up as the pontoons are deballasted, putting the trailer in a floating mode; (2) the trailer and boat are winched together, finally resulting in recoupling the hitch, joint or swivel; and (3) the pontoons are substantially fully deballasted and the legs are jacked up to a "raised" position. The trailer is then ready for movement to another location.

The hydrostatic and hydrodynamic design of the platform are coordinated so that the trailer tongue (or gooseneck arm) will be light at the uncoupling condition, permitting the tongue (or arm) to raise away from the hitch (joint or swivel) on the deck of the supply boat, without subsequent collision.

DISCUSSION OF THE PRIOR ART

U.S. Pat. No. 3,323,478 discloses a method of joining two vessels of conventional shape using spreader bars and tie lines, with a truss work between the vessels supporting a drilling rig. The joined vessels are like a hinged catamaran and not like the present invention. In the present invention the trailer is at the stern of the towing vessel, as opposed to alongside the vessel. Also, the present invention is structurally joined to the towing vessel with a single ball swivel joint and not the complicated means shown in U.S. Pat. No. 3,323,478.

*The Technology of Offshore Drilling, Completion and Production* by ETA Offshore Seminars, Inc., 1976, page 4, describes conventional jackup vessels. These vessels are free standing, either self-propelled and positioned with thrusters or non-propelled. If the jackup unit is not self-propelled, it is towed to its work location by town vessels using tow lines between the tow vessels and the jackup vessel. Thus, the jackup vessel is handled like a conventional barge. By comparison with a free standing jackup vessel, the present invention has one corner (or side) supported by a structural ball swivel joint on the deck of a tow vessel. So, in effect, the present invention is like a trailer at the rear of the tow vessel and is markedly dissimilar to a free floating jackup vessel in its transit mode.

*Manned Submersibles* by R. Frank Busby, 1976, page 611, Office of the Oceanographer of the U.S. Navy, shows how a spar buoy assembly can be connected alongside a floating vessel by way of a single-degree-of-freedom hinge (like a door hinge). This assembly then can be used to support operations of a subsea nature. By comparison with the present invention, (a) the spar buoy assembly is positioned alongside the vessel and not behind it; (b) the spar buoy assembly has no submerged pontoon on the ocean floor to permit heavier lifts, (c) the hinge point of the spar buoy assembly is well above the vessel deck so that roll motion of the vessel is amplified into a sizable transverse motion and rotation of the spar buoy assembly, and (d) the hinge of the spar buoy assembly is a simple one-degree-of-freedom hinge and not a ball swivel hinge having three degrees of freedom as in the present invention. Hence, there are few similarities between the present invention and the spar buoy assembly.

What is claimed is:

1. A jackup platform trailer comprising a deck structure supported by submersible flotation means, means for extending the flotation means downwardly beneath the deck structure, means for pivoting the flotation means and deck structure, and connecting means extending between the deck structure and the pivoting means.

2. The trailer of claim 1 wherein the pivoting means comprises a swivel joint.

3. The trailer of claim 1 wherein the flotation means comprises pontoons.

4. The trailer of claim 1 wherein the connecting means comprises at least one truss.

5. The trailer of claim 1 wherein the pivoting means is attached to floating support means.

6. The trailer of claim 5 wherein the support means is a vessel.

7. The trailer of claim 1 wherein the pivoting means is attached to non-floating support means.

8. The trailer of claim 7 wherein the support means is a dock.

9. The trailer of claim 2 including tie lines connecting the deck structure to means supporting the pivoting means.

10. The trailer of claim 3 including means for ballasting the pontoons.

11. The trailer of claim 2 wherein the swivel joint is mounted on a floating vessel at least near the center of pitch on the deck of the vessel.

12. The trailer of claim 1 wherein supply moving means is operatively engaged with the connecting means to move supplies between means supporting the pivoting means and the deck structure.

13. The trailer of claim 2 wherein the swivel joint is releasably mounted on moving means.

14. The trailer of claim 13 wherein the moving means is a track extending longitudinally on support means.

15. The trailer of claim 13 wherein the moving means is a slot extending longitudinally on support means.

16. The trailer of claim 1 including a crane mounted on the deck structure.

17. The trailer of claim 1 including launch/recovery means for a submarine.

18. A method for transporting and positioning a jackup platform trailer having a deck structure supported by downwardly extendable, submersible flotation means and connection means extending from the deck structure to pivoting means connectable to a two vessel, comprising towing the trailer with the vessel to a desired location, partially ballasting down the flotation means to stabilize the trailer, releasing the pivoting means from the vessel, and fully ballasting down the flotation means to the sea floor.

19. The method of claim 18 wherein upward pressure is exerted at the pivoting means as the flotation means is partially ballasted down, so that the connection means raises away from the tow vessel when the pivoting means is released.

20. The method of claim 19 wherein a tow line is attached from the vessel to the trailer near the pivoting means.

21. The method of claim 20 wherein the tow line is released from the trailer after the flotation means is fully ballasted down.

22. The method of claim 20 wherein the flotation means is partially deballasted and moved upwardly to place the trailer in a floating mode.

23. The method of claim 22 wherein the tow line is employed to winch the vessel and trailer together at the pivoting means.

24. The method of claim 23 wherein the flotation means is fully deballasted to place the trailer in a transport mode.

25. The method of claim 24 wherein downward pressure is exhibited at the pivoting means as the flotation means is fully deballasted.

* * * * *